US006571707B2

(12) United States Patent
Pfeiffer et al.

(10) Patent No.: US 6,571,707 B2
(45) Date of Patent: Jun. 3, 2003

(54) METHOD OF STARTING UP A PRINTING MACHINE

(75) Inventors: Nikolaus Pfeiffer, Heidelberg (DE); Uwe Stang, Neckargemünd/Dilsberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 233 days.

(21) Appl. No.: 09/730,272

(22) Filed: Dec. 5, 2000

(65) Prior Publication Data

US 2001/0006027 A1 Jul. 5, 2001

(30) Foreign Application Priority Data

Dec. 6, 1999 (DE) ..... 199 58 652

(51) Int. Cl.[7] ..... B41F 35/00
(52) U.S. Cl. ..... 101/425; 101/483; 101/365
(58) Field of Search ..... 101/425, 211, 101/218, 349.1, 350.1, 352.01, 352.05, 365, 483, 484, 492

(56) References Cited

U.S. PATENT DOCUMENTS

| | | | | | |
|---|---|---|---|---|---|
| 2,844,096 | A | * | 7/1958 | Koch | 101/218 |
| 4,000,692 | A | * | 1/1977 | Wirz et al. | 101/352.05 |
| 4,660,470 | A | * | 4/1987 | Kramp et al. | 101/365 |
| 5,081,926 | A | * | 1/1992 | Rodi | 101/211 |
| 5,921,184 | A | * | 7/1999 | Sugiyama et al. | 101/365 |
| 5,983,793 | A | * | 11/1999 | Volz et al. | 101/218 |
| 6,055,907 | A | * | 5/2000 | Endisch et al. | 101/352.01 |

FOREIGN PATENT DOCUMENTS

| | | |
|---|---|---|
| DE | 2 113 608 | 9/1972 |
| DE | 40 13 740 A1 | 1/1991 |
| DE | 40 13 463 A1 | 11/1991 |

* cited by examiner

*Primary Examiner*—Eugene H. Eickholt
(74) *Attorney, Agent, or Firm*—Laurence A. Greenberg; Werner H. Stemer; Ralph E. Locher

(57) ABSTRACT

A method of starting up a printing machine after washing a rubber blanket thereof, includes pre-inking the rubber blanket by performing at least one complete revolution of the rubber blanket in contact with the inked printing plate before the start of printing.

5 Claims, 2 Drawing Sheets

METHOD OF STARTING UP A PRINTING MACHINE

BACKGROUND OF THE INVENTION

Field of the Invention

The invention relates to a method of starting up a printing machine after washing a rubber blanket thereof.

The rubber blanket is used to transfer ink from a plate cylinder, whereon a printing plate is mounted, to a printing material, which runs through a nip between the blanket cylinder and an impression cylinder. During a production printing run, a given quantity of ink is always present on the blanket cylinder, and this quantity is refilled by the plate cylinder to the extent to which it is transferred to the printing material. When the printing machine is started up after the rubber blanket has been washed, this layer of ink is missing. Therefore, at the beginning of the start-up, the rubber blanket removes a quantity of ink from the plate cylinder which is significantly greater than that during the production printing run; the layer produced on the rubber blanket, consequently, is thin when compared with production printing, however, and the resulting imprint on the printing material is weak. Therefore, every time a printing machine is started up after the rubber blanket has been washed, a start-up phase of some ten sheets duration is necessary in order to achieve the production printing state. Within this start-up phase, waste sheets or rejects are printed.

SUMMARY OF THE INVENTION

It is accordingly an object of the invention to provide a method of starting up a printing machine which permits the start-up phase to be shortened, and the quantity of rejects or waste to be reduced.

With the foregoing and other objects in view, there is provided, in accordance with the invention, a method of starting up a printing machine after washing a rubber blanket thereof, which comprises pre-inking the rubber blanket by performing at least one complete revolution of the rubber blanket in contact with the inked printing plate before the start of printing.

In accordance with another mode, the method invention includes performing a plurality of complete revolutions, between 4 and 20 thereof, of the rubber blanket.

In accordance with a further mode, the method invention includes, before the start of printing, feeding a given quantity of ink into the inking unit of the printing machine, in order to compensate for the loss of ink in the inking unit resulting from pre-inking the rubber blanket.

In accordance with an added mode of the method invention, the given quantity of ink at least approximately corresponds to the quantity of ink on the rubber blanket under production printing conditions.

In accordance with an additional mode, the method invention includes concluding the feeding in of the given quantity of ink by starting up the printing operation.

In accordance with a concomitant mode, the method invention includes feeding in an excess quantity of ink during the printing of the first printed sheet.

Thus, the method according to the invention calls for the rubber blanket to be pre-inked, by performing at least one complete revolution in contact with the inked printing plate, in a prior phase before the start of printing.

In order to compensate for the loss of ink in the inking unit caused by the pre-inking, a given quantity of ink is previously fed into the inking unit, preferably before the start of printing. This quantity of ink corresponds in substance to the quantity of ink which would be found on the rubber blanket under production printing conditions.

The action of feeding in the quantity of ink can be begun before or after the beginning of pre-inking. In order to have a good ink gradient in the printing unit, as similar as possible to production printing, at the beginning of printing, the flow of ink fed in during the prior phase is preferably metered so that as the printing operation starts, the given quantity of ink is just being fed in.

Other features which are considered as characteristic for the invention are set forth in the appended claims.

Although the invention is illustrated and described herein as embodied in a method of starting up a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
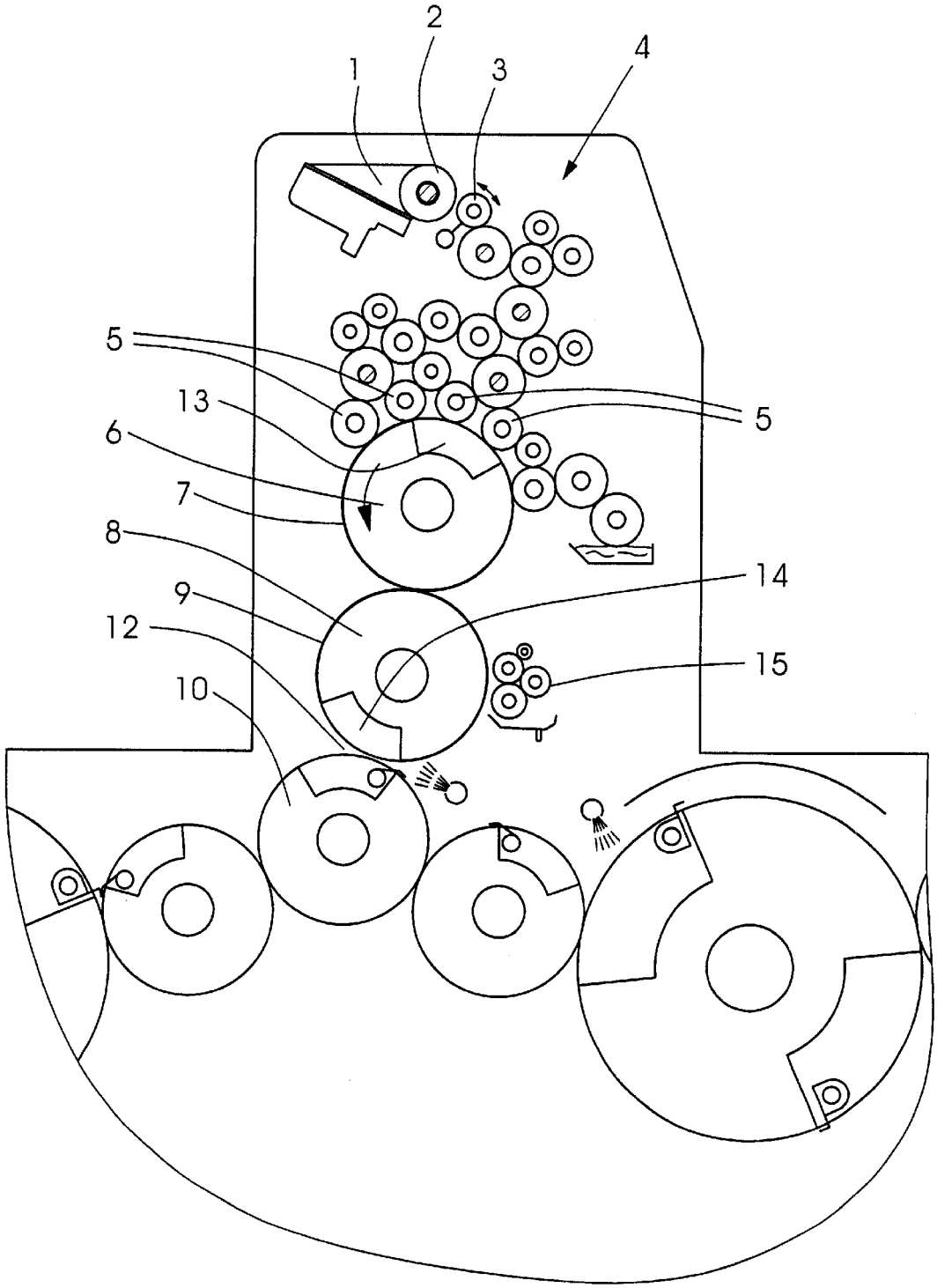
FIG. 1 is a diagrammatic side elevational view, of a printing unit of a printing machine.

Referring now to the drawings and, first, particularly to FIG. 1 thereof, there is shown therein a printing unit of conventional construction, which therefore needs no explanation except only to the extent required for an understanding of the method according to the invention.

The printing unit includes an ink source in the form of an ink fountain 1 with a fountain roller or ductor 2 and a vibrator roller 3, which oscillates between the fountain roller 2 and a first roller of an inking unit 4 in order to transfer ink from the fountain roller 2 into the inking unit 4. A number of ink applicator rollers 5 distribute ink from the inking unit 4 to a printing plate 7 mounted on a plate cylinder 6. A rubber blanket 9 is tautened or stretched over a blanket cylinder 8, which is displaceable between an active position thereof illustrated in FIG. 1, wherein the rubber blanket 9 and the printing plate 7 roll on one another, and an inactive position thereof, (not illustrated) wherein the rubber blanket 9 and the printing plate 7 are spaced apart from one another. In its inactive position, the rubber blanket 9 can be washed with the aid of a washing device 15.

Furthermore, an impression cylinder 10 is also provided which, in an active position thereof, engages the blanket cylinder 8 at a nip 12, through which printing material is guided in order to be printed.

For the purpose of washing the rubber blanket 9, the printing unit is stopped, and the blanket cylinder 8 is moved into the inactive position thereof, wherein it engages neither the plate cylinder 6 nor the impression cylinder 10. In addition, the ink applicator rollers 5 are moved away from the plate cylinder 6.

In order to start up the printing machine again after the washing operation, in the conventional manner, the diverse rollers and cylinders are set into rotation again and, at the same time that the vibratory roller 3 is switched on, the ink applicator rollers 5 are brought into engagement with the plate cylinder 6 again.

When, after starting the rotation, the cylinder gap 13 formed in the plate cylinder 6 reaches a position thereof facing towards the cylinder gap 14 formed in the blanket cylinder 8, the blanket cylinder 8 is moved back into the active position thereof wherein it is in contact with the plate cylinder 6. In this way, the inking of the rubber blanket 9 is always begun at the start of printing. When, after the rotation continues, the cylinder gap 14 formed in the blanket cylinder 8 reaches the impression cylinder 10, these two cylinders 8 and 10 are also brought into contact again, and the printing material starts to be fed through the nip 12.

Figure 2:
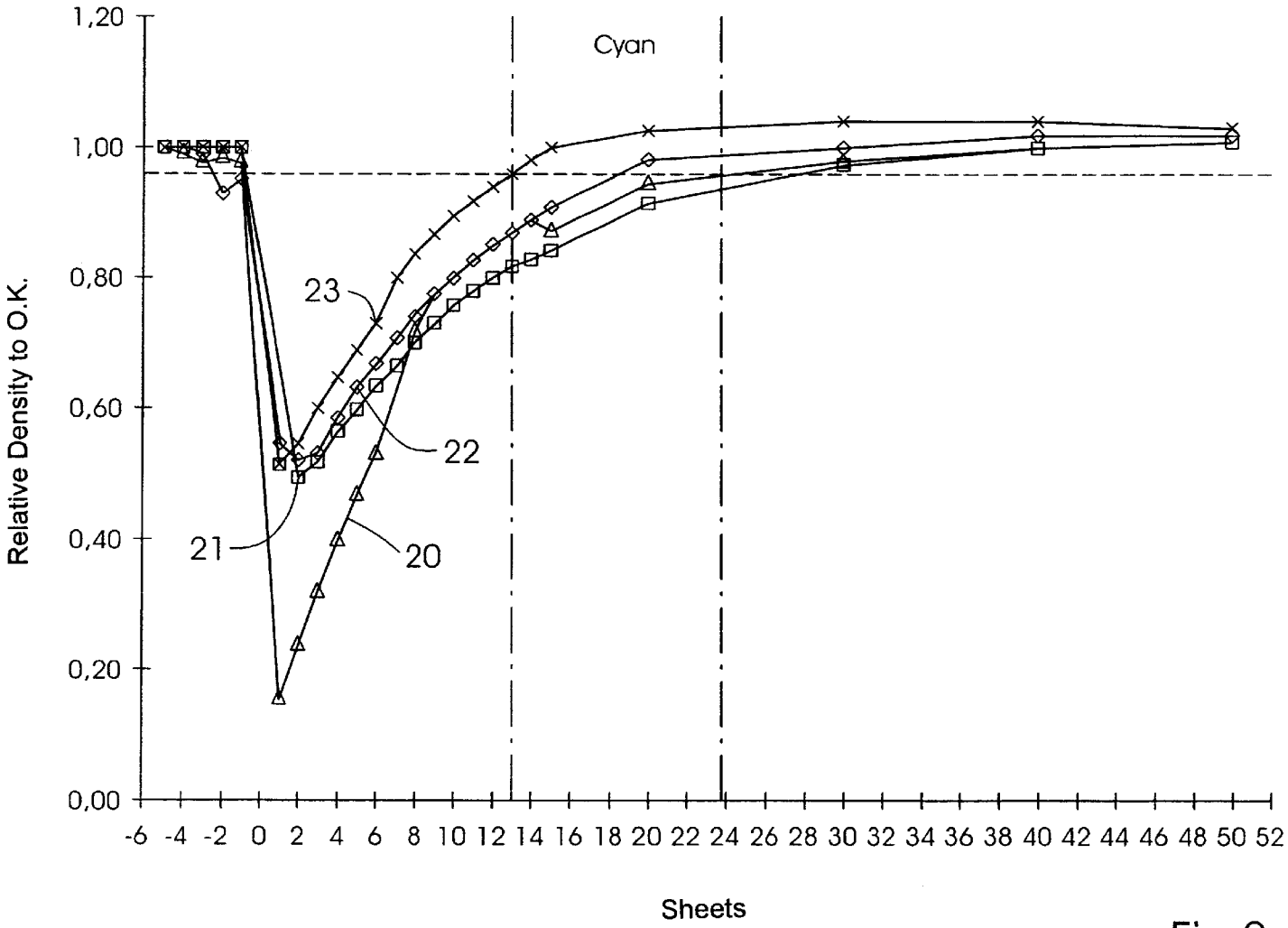
FIG. 2 is a plot diagram showing the development over time of the ink density in a print, using the ink color cyan, by way of example, during starting-up in accordance with a conventional method and in accordance with the method of the invention.

As a result of the contact between the plate cylinder 6 and the washed rubber blanket 8, a quantity of ink which is significantly greater than under production printing conditions is transferred to the rubber blanket 9. This leads to a noticeable disruption in the ink gradient from the ink source to the plate cylinder 6, but nevertheless, as a result of the single contact with the rubber blanket 9, the layer thickness which is necessary for a satisfactory print has not yet built up. As curve 20 in the plot diagram of FIG. 2 shows, the density of the cyan-colored ink in the first sheets printed after the start-up of the machine attains only a small fraction of the desired value, about 15%, and it is necessary for about 25 sheets to be printed before satisfactory densities are achieved. Trials performed with magenta inks and yellow inks showed a similar behavior of the ink density.

In the method according to the invention, after the rollers and the cylinders have been set into rotation again, initially, all of the ink applicator rollers 5 are set onto the printing plate 7. As soon as the cylinder gaps 13 and 14, respectively, formed in the plate cylinder 6 and the blanket cylinder 8 are located opposite one another, these two cylinders 6 and 8 are brought into contact, and a start towards building up an ink layer on the freshly washed rubber blanket 9 takes place. However, when this ink layer reaches the nip 12, printing is not yet started. Instead, the nip 12 remains open and, after a complete revolution of the blanket cylinder 8, the ink layer comes into contact again with the plate cylinder 6, at which further ink is transferred. If the number of revolutions of the rubber blanket 9 before the start of printing is high, equilibrium of the layer thicknesses is ultimately established between the printing plate 7 and the rubber blanket 9. However, it is not expedient to select a number of revolutions that is too high, because this would also equalize the ink gradient in the inking unit 4. In order to achieve production printing conditions, it would be necessary for this ink gradient to be reproduced thereafter. The number of complete revolutions which the blanket cylinder 8 expediently makes before the start of printing is therefore upwardly limited. Expedient numbers of complete revolutions in the prior phase lie within the range from 4 to 20, for example 8.

The curve 21 in FIG. 2 shows the development of the ink density on printed sheets when starting up the printing unit in accordance with the invention. Before the start of printing, eight complete revolutions of the blanket cylinder were made. As can be seen, the relative ink density at the beginning of a print job may be improved considerably by the pre-inking in accordance with the invention; the starting value is about 50%.

As a result of a preferred mode of the method according to the invention, not only does the blanket cylinder 8 perform a number of complete revolutions before the start of printing, but also ink is already fed into the printing unit during this prior phase. In order to maintain an ink gradient in the printing unit which is close to that under production printing conditions, the action of feeding in the ink is preferably regulated in such a way that the action of feeding a desired quantity of ink is concluded at the instant at which printing is started. Depending upon the magnitude of the desired quantity of ink, it is possible for the action of feeding ink in to be started earlier or later than the inking of the rubber blanket. The curves 22 and 23 in FIG. 2 show the measured relative ink density of printed sheets as a function of the quantity of ink fed in, specified as the number of ductor cycles. In order to record these curves, eight complete revolutions of the blanket cylinder were made, in order to pre-ink the rubber blanket and at the same time, ink was fed into the inking unit, with four ductor cycles in the case of curve 22 and, respectively, six ductor cycles in the case of curve 23. The portion of ink transferred in each vibrator-roller cycle was the same as under production printing conditions.

It is apparent that the number of sheets which have to be printed until a satisfactory ink density, corresponding to 95% of the desired value, is reached, is reduced considerably when compared with conventional methods and also when compared with the method with pre-inking of the rubber blanket but without the accompanying action of feeding in ink.

We claim:

1. A method of starting up a printing machine after washing a rubber blanket thereof, which comprises pre-inking the rubber blanket by performing at least one complete revolution of the rubber blanket in contact with an inked printing plate, and feeding a given quantity of ink into an inking unit of the printing machine, in order to compensate for a loss of ink in the inking unit resulting from pre-inking the rubber blanket before the start of printing.

2. The method according to claim 1, which includes performing a plurality of complete revolutions, between 4 and 20 thereof, of the rubber blanket.

3. The method according to claim 1, wherein the given quantity of ink at least approximately corresponds to the quantity of ink on the rubber blanket under production printing conditions.

4. The method according to claim 1, which includes concluding the feeding in of the given quantity of ink by starting up the printing operation.

5. The method according to claim 4, which includes feeding in an excess quantity of ink during the printing of the first printed sheet.

* * * * *